US010793985B2

(12) United States Patent
Salinas Torres

(10) Patent No.: US 10,793,985 B2
(45) Date of Patent: Oct. 6, 2020

(54) PORTABLE WASHER AND DRYER UNIT FOR LINGERIE

(71) Applicant: Luz Andrea Salinas Torres, Los Angeles, CA (US)

(72) Inventor: Luz Andrea Salinas Torres, Los Angeles, CA (US)

( * ) Notice: Subject to any disclaimer, the term of this patent is extended or adjusted under 35 U.S.C. 154(b) by 153 days.

(21) Appl. No.: 16/260,020

(22) Filed: Jan. 28, 2019

(65) Prior Publication Data

US 2020/0240063 A1 Jul. 30, 2020

(51) Int. Cl.

| | |
|---|---|
| ***D06F 13/02*** | (2006.01) |
| ***D06F 39/00*** | (2020.01) |
| ***D06F 95/00*** | (2006.01) |
| ***D06F 39/12*** | (2006.01) |
| ***D06F 17/00*** | (2006.01) |
| ***D06F 7/02*** | (2006.01) |
| ***D06F 33/00*** | (2020.01) |

(52) U.S. Cl.

CPC ..... *D06F 13/02* (2013.01); *D06F 39/001* (2013.01); *D06F 95/008* (2013.01); *D06F 7/02* (2013.01); *D06F 17/00* (2013.01); *D06F 33/00* (2013.01); *D06F 39/125* (2013.01)

(58) Field of Classification Search

CPC ..... D06F 13/02; D06F 39/001; D06F 95/008; D06F 7/02; D06F 17/00; D06F 33/00; D06F 39/125; D06F 13/00; D06F 15/00; D06F 27/00

USPC ..... 68/23.7, 3 R, 13 R, 63, 84, 87, 88, 92, 68/93, 220, 240, 74–81, 212

See application file for complete search history.

(56) References Cited

U.S. PATENT DOCUMENTS

| | | | | |
|---|---|---|---|---|
| 3,139,744 | A * | 7/1964 | Van Alstyne | D06F 29/005 68/20 |
| 3,402,576 | A * | 9/1968 | Krupsky | A47L 15/0097 68/4 |
| 4,454,732 | A * | 6/1984 | Burkland | D06F 39/12 248/639 |
| 4,989,426 | A * | 2/1991 | Kretchman | D06F 29/00 248/676 |
| 2003/0215357 | A1* | 11/2003 | Malterer | G01N 35/028 422/50 |
| 2007/0151302 | A1* | 7/2007 | Kendall | D06F 39/00 68/3 R |

OTHER PUBLICATIONS

"Giantex Portable Washer Reviews: Ultimate Guide"; product review online, https://washingsolution.com/giantex-portable-mini-twin-tub-washing-machine; Oct. 24, 2016.

"Compare Portable Electric Washing Machines: Pyle PUCWM22 vs. Haier HLP21N"; Product review; https://www.top-productcomparisons.com/compare-portable-washing-machines-panda-xpb36-or-haier-hlp21n.html; Oct. 2015.

* cited by examiner

*Primary Examiner* — Justin M Jonaitis
(74) *Attorney, Agent, or Firm* — Ernesto Garcia

(57) ABSTRACT

A washer and dryer unit offers gentle washing or drying of lingerie including bras and panties. The unit uses a series of reciprocating bristles made of a specific elastic material that does not damage the lingerie. A washer compartment of the unit is adjustable to allow insertion of different sized bras that are mounted on a support grille. A dryer compartment of the unit offers drying of the lingerie using air fans. The unit is portable and small to be placed in a bathroom.

20 Claims, 5 Drawing Sheets

PORTABLE WASHER AND DRYER UNIT FOR LINGERIE

TECHNICAL FIELD

The portable washer and dry unit pertains to properly washing lingerie clothing in particular women's bra or panties and thongs.

BACKGROUND OF THE INVENTION

Intimate clothing is very delicate for women today in particular expensive lingerie. Normally, women wash bras by hand or a conventional washer and dryer, which can cause irreversible damage to the garments. This manual process of washing implies a dedication of time and the use of specific detergents, which can cause abuse to skin. The washing is usually done in the sink or in the shower by making use of house items to soak for a few hours. This requires ample space to put the items to soak, which occupies space that is not intended for this use. Normally, different softeners are used on all types of clothing when using a washing machine and mixing different garments will weaken the material of the lingerie.

Others have made specific containers where one places a bra inside and tossed inside a washing machine with other garments. Such approach requires that the cycle be rough on all the garments to be washed since it is tossed with other clothing to be washed at the same time. The agitator of the washing machines just ruins the expensive material.

SUMMARY OF THE INVENTION

The instant invention envisions a female underwear washer and dryer unit being a machine designed especially for washing intimate garments avoiding deformation of material, bending of rods, entanglement of brooches with other clothes, and no crushing. The washer and dryer unit does not wear or pierce garment unlike a conventional washer machine due to the centrifugal forces when turning and crushing mixed clothes against the drum of the washing machine.

The instant invention meets the optimal conditions of the manufacturers' suggestions for handling lace care, elastics, rods, brooches, elasticity, and shape of lingerie. The object of this invention is to create an exclusive unit having a washing compartment and a dryer compartment for handling intimate clothing. The washing compartment offers adaptability for a variety of sizes and designs of lingerie clothing. Another objective of this invention is that the garments come out with a fresh and renewed scent that is different from using a convention washing machine. It uses a specialized strings of material bundled like a that won't affect the materials from which the lingerie is made from. The pompoms are arranged in an array to cover the compartment's height in two opposite sides.

An important feature of this invention is the adjustability to wash different comfortable sizes and transportability of moving the unit to different places in a home where there is a water tap, drain, and plug.

The invention will not make use of the centrifugal force commonly used in a conventional washing machine. The bra or thong will not spin without control inside the washing compartment or dryer, which can cause damage to the garments. It will be a machine that adjusts and adapts to the shape of each garment. The invention will offer soak time with soft rolling. Another object in this invention is that the dryer will not use heat but instead it will make use of air circulating in the compartment to air dry using at least one fan. This solution lowers energy consumption avoiding using heat, which can also damage the garments. The pompoms offer an extra soft friction to clean the garments set at different time cycles according to personal criteria and manufacturers recommendations.

DETAILED DESCRIPTION

Figure 1:
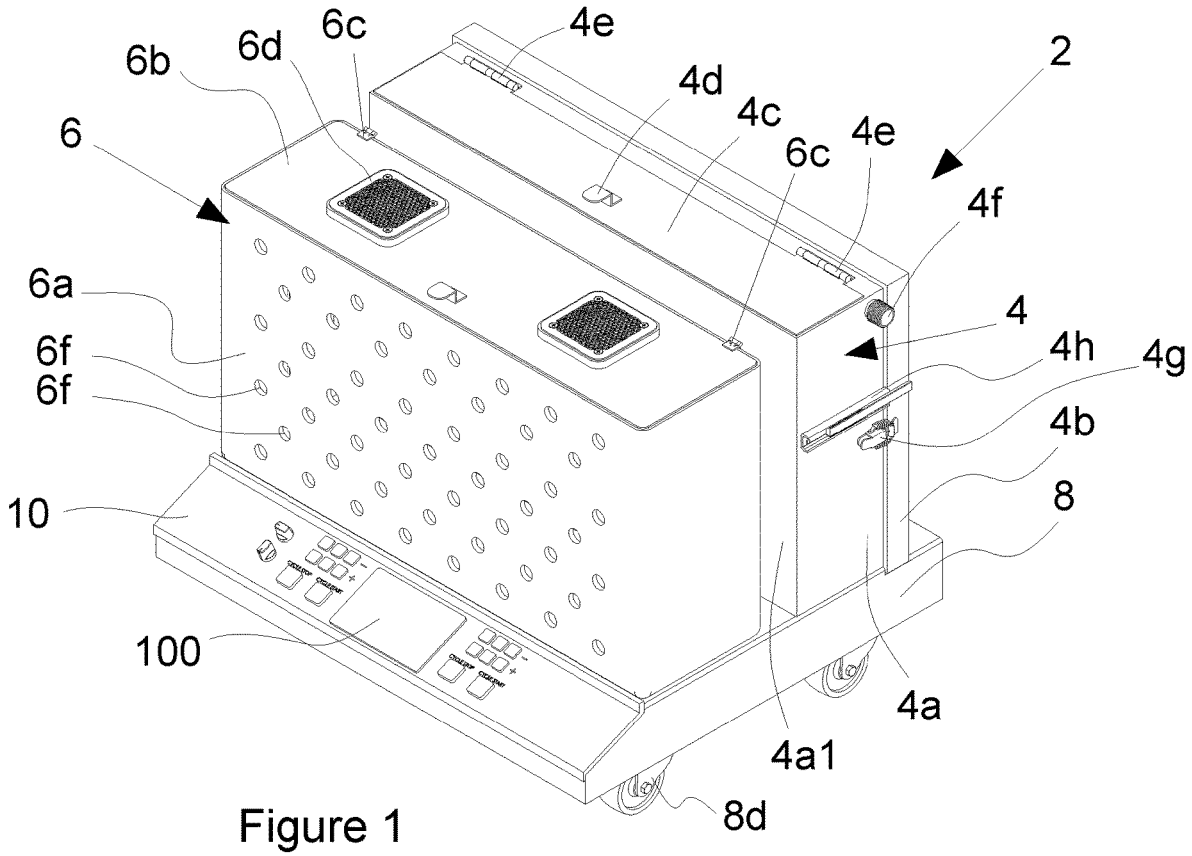
FIG. 1 shows an isometric view of a washer and dryer unit.
Figure 2:
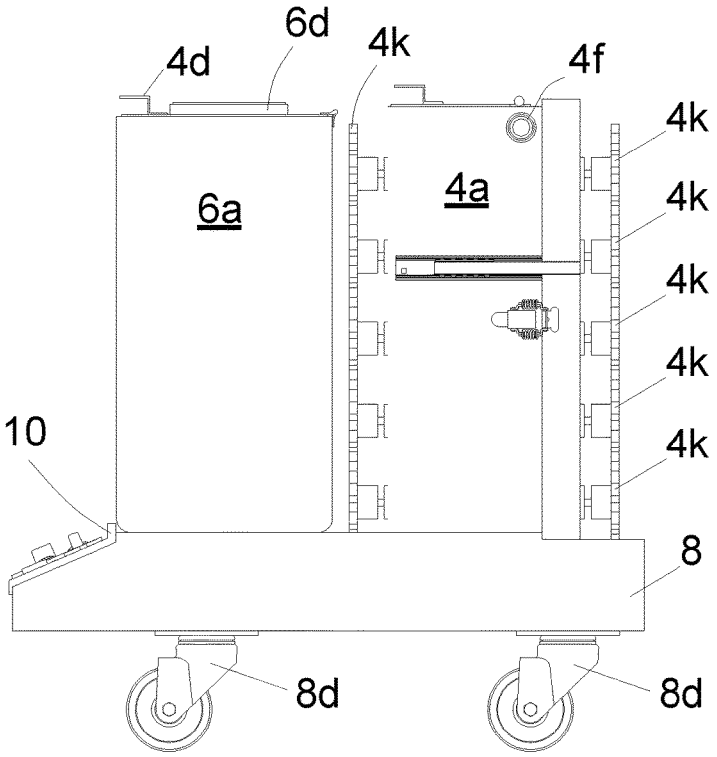
FIG. 2 shows a right side view of the washer and dryer unit shown in FIG. 1.
Figure 3:
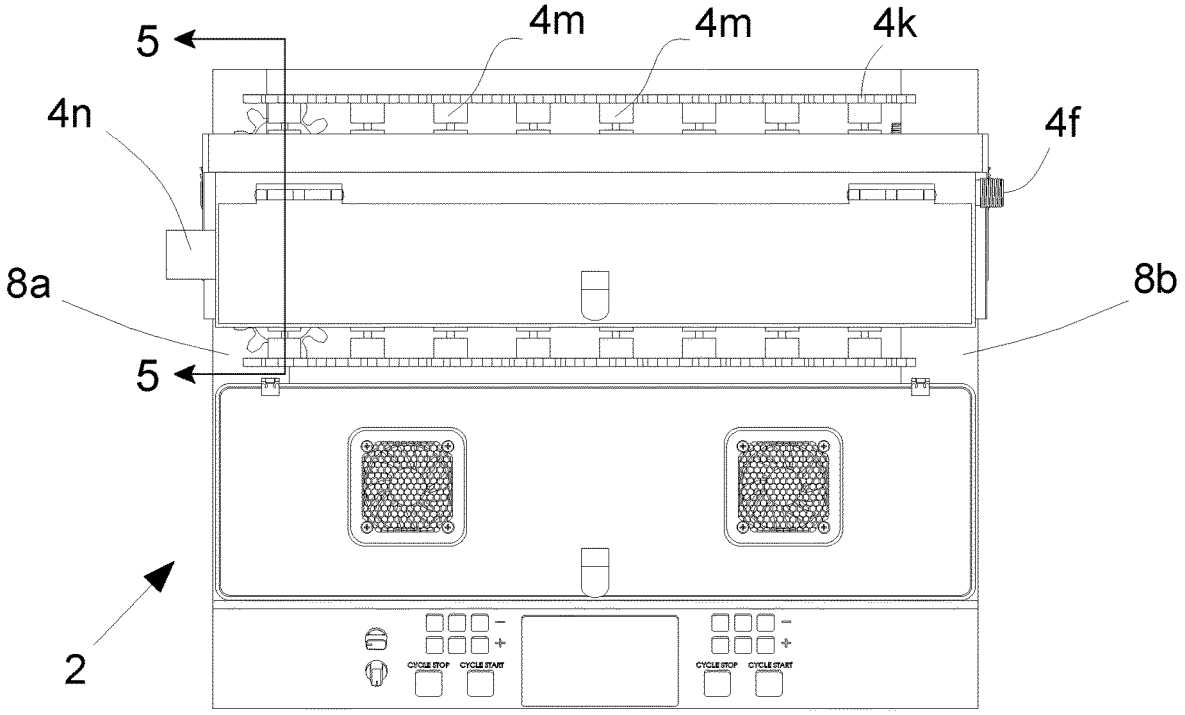
FIG. 3 shows a top view of the washer and dryer unit shown in FIG. 1.
Figure 4:
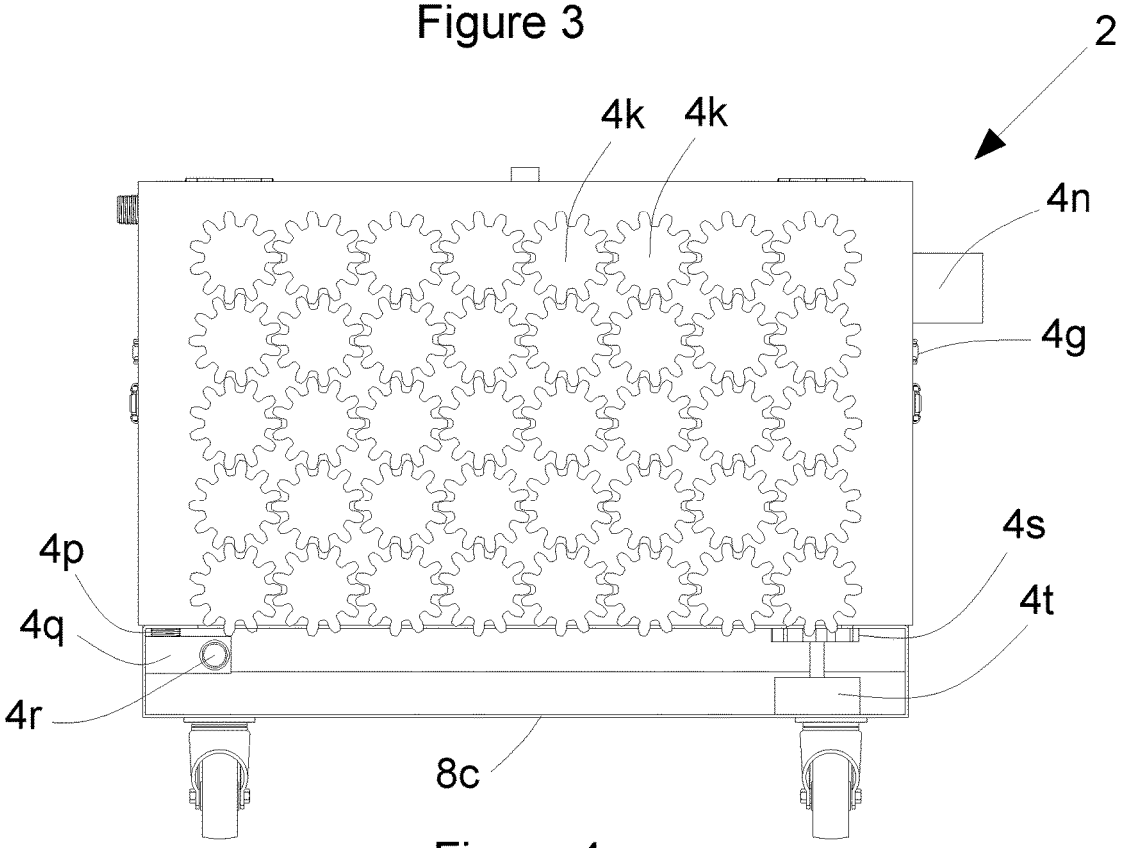
FIG. 4 shows a back view of the washer and dryer unit shown in FIG. 1.

FIG. 1 shows a washer and dryer unit 2. The unit 2 comprises a washer compartment 4 and a dryer compartment 6. The washer compartment 4 comprises an opened container 4*a* and a cover 4*b*. The container 4*a* includes a planar wall 4*a*1 and a door 4*c* that is connected to the container 4*a* using two hinges 4*e*. The door 4*c* contains a handle 4*d* to permit one to open the door 4*c* with ease. The cover 4*b* is slidably supported relative to the container 4*a* using sliders 4*h* that allow the cover 4*b* to slide open laterally to the container 4*a*. To keep the cover 4*b* locked relative to the container 4*a*, a pair of compression spring loaded latches 4*g*, known as tight-hold draw latches, are utilized. It is envisioned that more than two compression spring loaded latches can be used such a placing a third one in the bottom of the container 4*a*. The cover 4*b* also has a planar wall 4*b*1. The container 4*a* of the washer compartment 4 includes an inlet port 4*f* projecting from a side of the container 4*a*. This inlet port 4*f* allows for a hose to be connected and fill the washing compartment 4 with water. The inlet port 4*f* connects to a closed pipe 28 that extends the length of the container 4*a*. The closed pipe has a series of drain ports 28*a* for water to fill the container 4*a* with a spray or drip action. The container 4*a* further includes a drain port 4*p* that is connected to a drain system 4*q* with an outlet port 4*r* to be connected to hose and drain the washing compartment 4 after a cycle.

The dryer unit 6 comprises a container 6*a* with a door 6*b* hingedly connected using two hinges 6*c*. The door 6*b* also contains a handle 4*d* to allow a user to open the door 6*b*. The container 6*a* contains an array of vent openings 6*f* that allow air generated from at least one fan 6*d* mounted on the door 6*b*. The fan 6*d* is utilized to air dry the garments. Air generated by the fan 6*d* travels out the vent openings 61. Both containers 4*a*, 6*a*, rest on two opposite support flanges

8*a*, 8*b* of a base 8 which contains a few wheels 8*d* affixed to frame 8*c* of the base 8 to make the unit 2 portable. A control panel 10 also seats on top of the bottom support 8, where knobs and a touchscreen 100 allows control of the unit 2. It is envisioned that the control panel is like any other control panel used to operate a dryer or washer.

As seen in FIGS. 2-5, the container 4*a* of the washing compartment and the cover 4*b* holds an array of meshing gears 4*k*, which are each connected to a bundled pompom 26. Each pompom 26 is composed from a bundle of strings made of a specific and import material that would not damage garments. This material is made from elastic material very importantly from polyether-polyurea copolymer better known as Spandex™ and the diameter of each string is 0.5 mm(0.02"). The bundles are made into pompoms 26, which are connected to a shaft support 20 via strung wire 22*a*. Each gear 4*k* contains a shaft 4*k*1 intersecting a seal 4*m*. The shaft support 20 has a threaded hole 20*a* to be connected to the shaft 4*k*1. The seal 4*m* comprises a pair of elastic discs 12*a* importantly made from an elastomeric hydrocolloid material. The elastomeric material is a polyurethane film having absorbing sodium carboxymethylcellulose particles encapsulated in a synthetic adhesive matrix. This is a tacky gel on only one side of the discs that will be used to adhere and seal on one side and spin freely on the other side. The adhesive matrix is composed of a hydrophobic polymer and has a tackifier such as a synthetic resin. One such material is known as Comfeel™ Ulcer Dressing, #3218.

Each disc 12*a* has an undersize hole 12*b* for the shaft 4*k*1 to be inserted therein forming a tight seal therein. Between the discs 12*a* is a flexible bridge tube 14 filled with grease 14*a*. The grease used in this invention is known as Red "N" Tacky Grease™ produced by Lucas Oil Products, Inc., which is a smooth, tacky, red lithium complex grease fortified with rust and oxidation inhibitors and has good water resistance and washout properties. The bridge tube 14 is made from ethylene propylene diene monomer rubber (EPDM). To enclose and cover the two discs 12*a* and the flexible bridge tube 14, a cover tube 16 extends over the two discs 12*a*. The cover tube 16 is made from PVC Vinyl material and allows the two discs 12*a* to move therein. A number of disc shaft supports 18, each having two opposing bosses 18*a*, 18*b*, is adhesively bonded, to the planar wall 4*a*1 of the opened container 4*a* and to the planar wall 4*b*1 of the cover 4*b* forming two arrays of gears 4*k*, which become apparent that the pompoms 26 face each other. The adhesive used is a coating of preventive rust paint that adheres to metal and inherently seals such as POR15®. The disc shaft supports 18 include a through hole 18*c* passing between the two opposing bosses 18*a*, 18*b*, which receive shaft 4*k*1. One of the two opposing bosses 18*b* extends through an opening 4*a*2 in the planar wall 4*a*1 of the container 4*a*, which sets one of the arrays. The same can be said about the other array of gears 4*k*. One of the two opposing bosses 18*b* extends through an opening 4*b*2 in the planar wall 4*b*1 of the cover 4*b*. The other boss 18*a* abuts one of the discs 12*a*. The tackiness side of the disc 12*a*, which has the alginate coating, forms a tight seal against the bridge tube 14 and the other side of the disc 12*a* forms a seal through pressure against the bridge tube 14. The pressure is caused when the pompoms 26 are threaded to the shafts 4*k*1 compressing the seal 4*m*, which acts as a compression spring.

Figure 5:
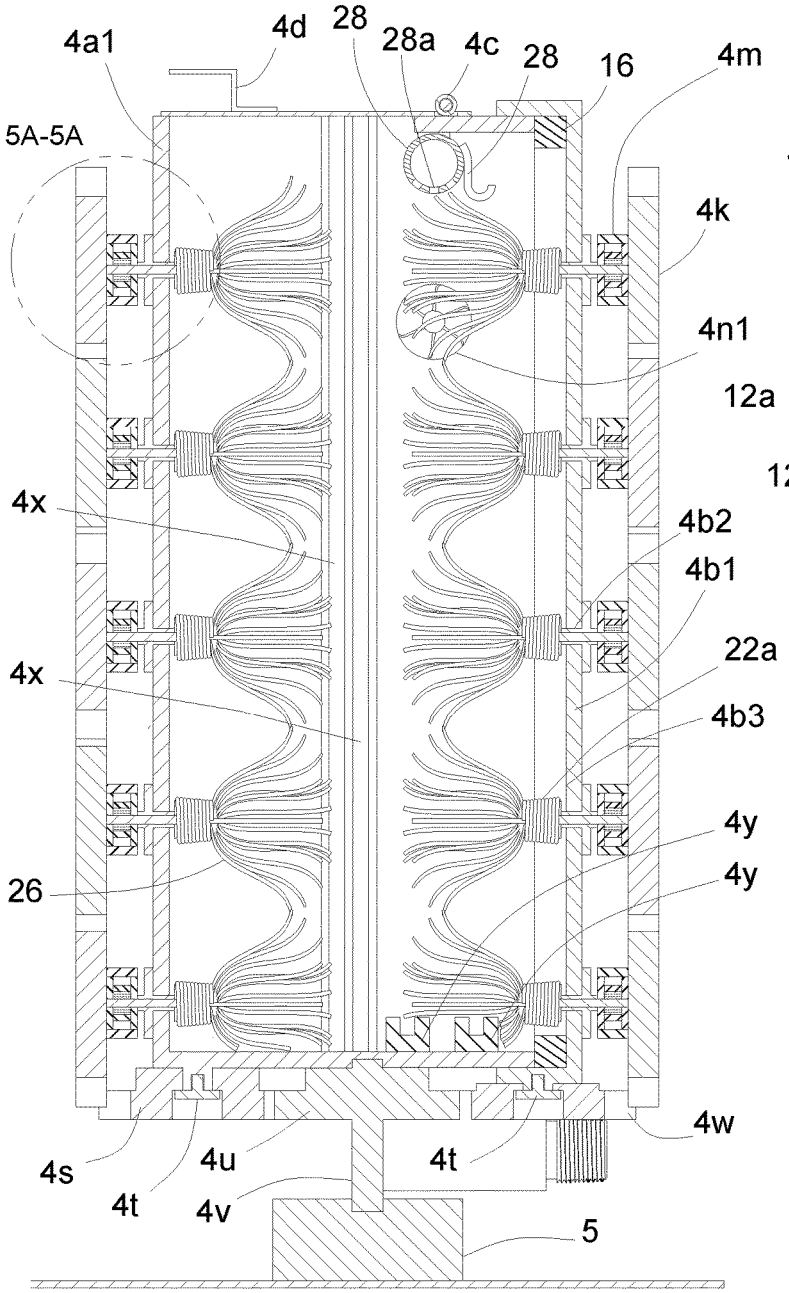
FIG. 5 shows cross-sectional view 5-5 shown in FIG. 3.
Figure 5A:
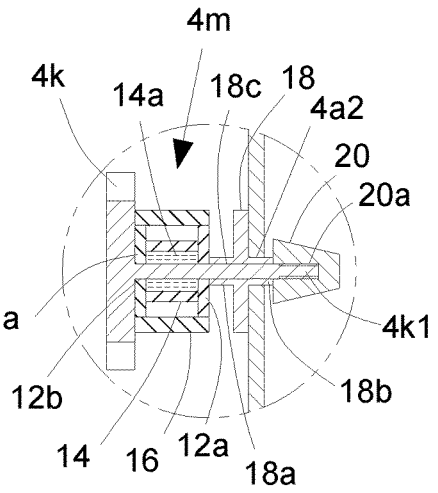
FIG. 5A shows cross-sectional view 5-5 shown in FIG. 3.
Figure 7:
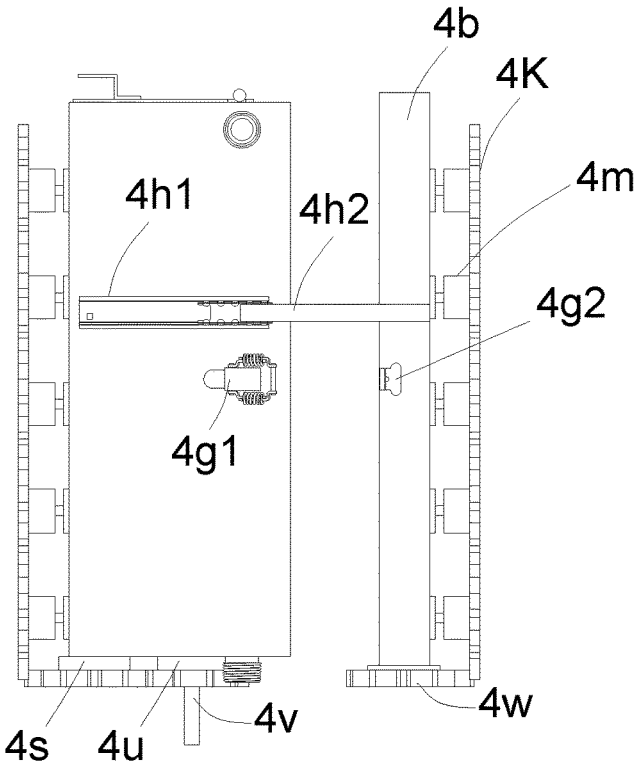
FIG. 7 shows a side view solely of the washer in an adjusted position.

As shown in FIGS. 5 and 7, the two array of gears 4*k* are set in motion by a drive gear 4*u* and a pair of bridge gears 4*s*, 4*w*. One of the bridge gears 4*s* is fixed to an underside of the container 4*a* through the use of a threaded fastener 4*t* and engages one of the gears 4*k* from an array arranged on the container 4*a*. The other bridge gear 4*w* is fixed to an underside of the cover 4*b* using a similar threaded fastener 4*t* and similarly engages one of the gears 4*k* from an array arranged on the cover 4*b*. The drive gear 4*u* is between the two bridge gears 4*s*, 4*w* and rotatably fixed to the underside of the container 4*a*. A shaft 4*v* extends from the drive gear 4*u*, which is driven by an electric servomotor 5. The details of the servomotor 5 is generic and the servomotor 5 is to spin the drive gear 4*u* in back and forth motion so as to rotate all the gears 4*k* of the arrays with 180 degree turning instead of spinning in full 360 degree motion one way. When the cover 4*b* is pull apart from the container 4*a*, the cover 4*b* becomes supported through the sliders 4*h*, which comprise a rail 4*h*1 affixed to the container 4*a*, and a moving guide 4*h*2 affixed to the cover 4*b*. It should be noted that the sliders are common drawer slides used in cabinetry but of course; any type of slider can be implemented. As the cover 4*b* is pulled apart, the bridge gear 4*w* disengages from the drive gear 4*u*, which allows the insertion of a support grille 22 into the container 4*a*. This is an alternative way to insert the support grille 22 into the container 4*a* instead of being inserted vertically into the container 4*a* when the door 4*c* is opened. When the support grille 22 is inserted this way laterally, the grille 22 can be inserted into one of the two horizontal U-channels 4*y* made from a rubber material. The top of the support grille 22 is supported vertically from a hook 28. Once the support grille 22 is placed properly, the cover 4*b* is closed by hooking the latch 4*g*1 of the container 4*a* onto the receiver 4*g*2 that is fixed to the cover 4*b*. The force generated by the compression spring loaded latches 4*g* allows for the cover 4*b* to compress and seal against a seal 16 that surrounds an inner cavity 4*b*3 of the cover 4*b*. If this lateral insertion of inserting the support grille 22 is not needed, a common approach to undersize garments can be inserting the support grille 22 into the container 4*a* when the door 4*c* is opened. In this approach, the support grille 22 slides into any pair of U-shaped channels 4*x* facing each other similarly located in the container 6*a* of the dryer compartment 6. This allows for the support grille 22 to stand vertically for washing or drying.

The washer and dryer unit 2 has a two setting washing cycle. One setting is a gentle soft cycle using a propeller or fan 4*n*1 that stirs water mixed with detergent. The propeller or fan 4*n*1 is sealingly fixed to the container 4*a* and spun using an electric motor 4*n*. The second washing cycle involves the use of the pompoms 26 to rotate back and forth at a specific frequency. Of course, it is envisioned that the cycle time can range from any amount of time and the frequency can be adjusted accordingly. After any cycle is complete, the dirty water will drain from the outlet port 4*r* through the use of the conventional drain system 4*q*.

Figure 8:
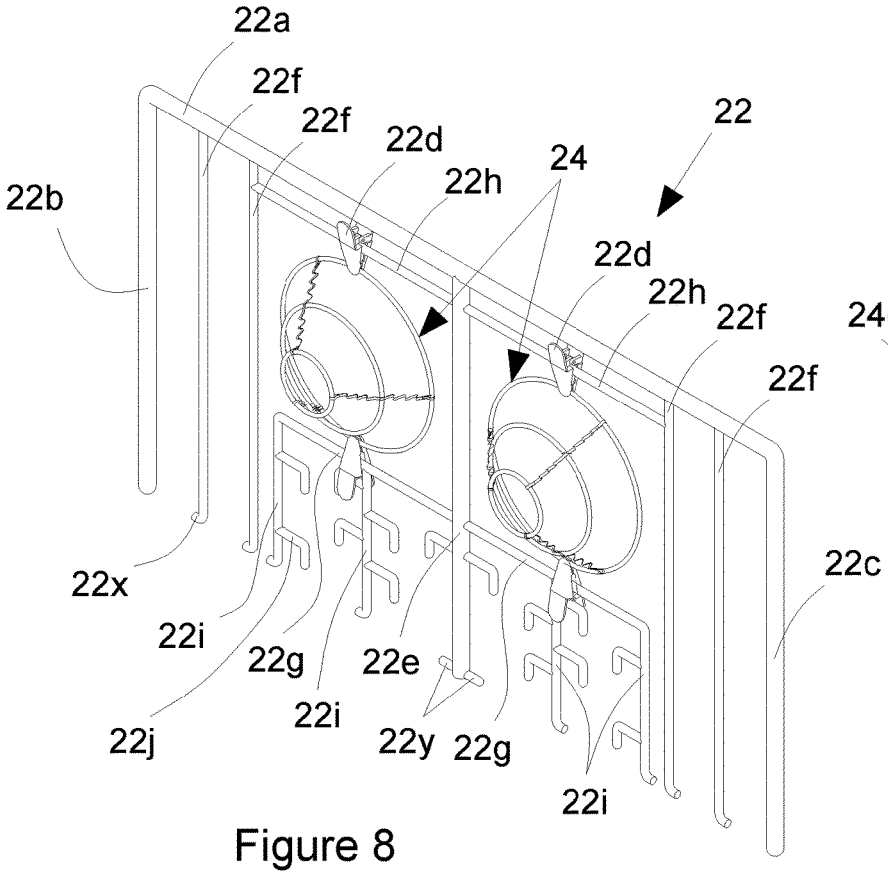
FIG. 8 shows an isometric view of a support grille used in the washer and dryer unit shown in FIG. 1.
Figure 10:
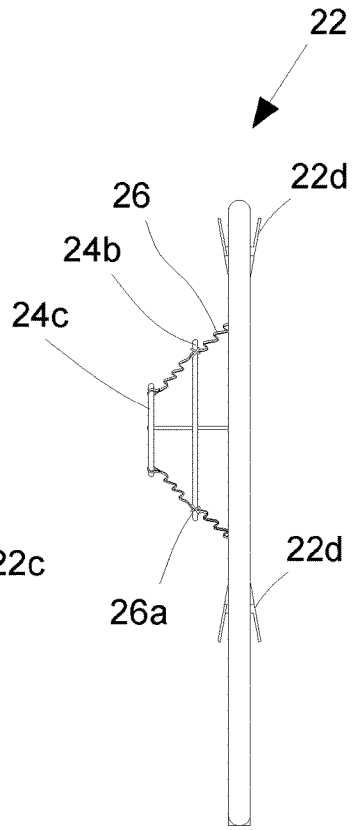
FIG. 10 shows a side view of the support grille shown in FIG. 8.
Figure 9:
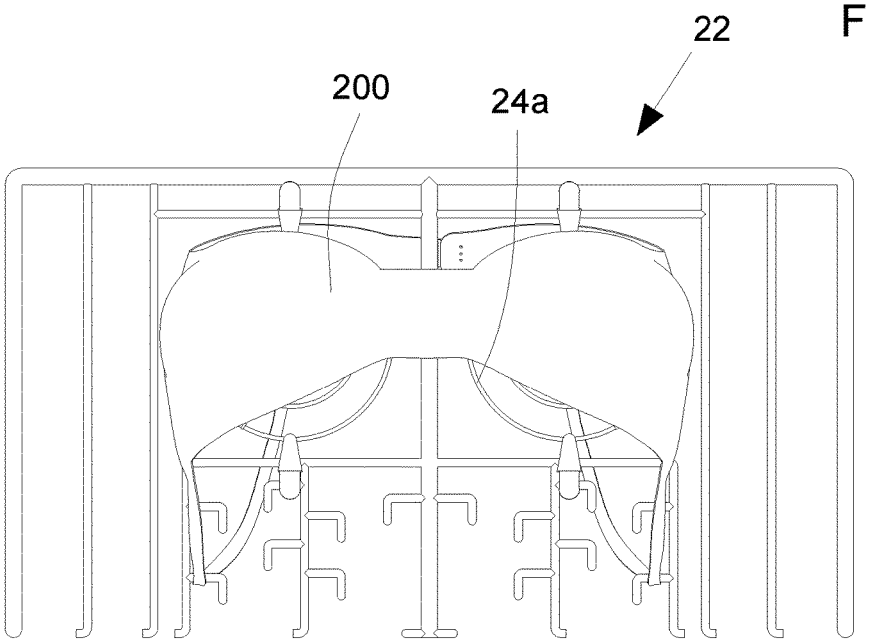
FIG. 9 shows a front view of the support grille shown in FIG. 8 used in conjunction with a bra.

FIGS. 8 to 10 show details of the support grille 22 and an application of use. The support grille 22 comprises a main bar 22*a* extending horizontal. Each end of the main bar 22*a* contains a vertical bar 22*b*, 22*c*, extending perpendicular to the main bar 22*a*. In a center portion of the main bar 22*a* extends a bisecting pole 22*e*. The vertical bars 22*b*, 22*c* and the bisecting pole 22*e* extend parallel to each other. Between the vertical bars 22*b* and the bisecting pole 22*e* extends two mid bars 22*f* extending the same direction as the vertical bars 22*b*, 22*c*. A bridge bar 22*h* extends between the bisecting pole 22*e* and one of the mid bars 22*f*. Cross bars 22*g* extend perpendicular to the bisecting pole 22*e* and short legs 22*i* extends perpendicular to the crossbars 22*g*. Each of the short legs 22*i* includes at least one hook 22*j*. It is optionally envisioned that the mid bars 22*f* and the short legs 22*i* terminate with a bent hook 22*x* and the bisecting pole terminates with two perpendicular projections 22*y*. Riding along the bridge bars 22*h* and the crossbars 22*g* are clips 22*d*, which also clip a pair of cup supports 24. The clips 22*d* are slidable along the bridge bars 22*h* and the crossbars 22*g* to shift the cup supports to a different position. The cup supports 24 comprise three concentric rings 24*a*-24*c* that are collapsible. Each rings being of a different size so that when the rings 24*a*-24*c* are uncollapsed, the rings 24*a*-24*c* for a cone shape to support the cups of a bra. Each of the rings 24*a*-24*c* are joined with flexible connectors 26 that comprise flexible wire wrapped with flexible plastic or alternatively as twist ties. The ends of the flexible connectors 26 are wrapped to the first concentric ring 24*a* and the third concentric rings 24*c*. A cross-wrapped filament 26*a* connects the flexible connector 26 mid way of the flexible connector 26 to the second concentric ring 24*b*. As shown in FIG. 9, a bra 200 is positioned on the support grille 22 to be either washed or dried. It is envisioned that the support grille 22 can be placed upside-down.

Figure 6:
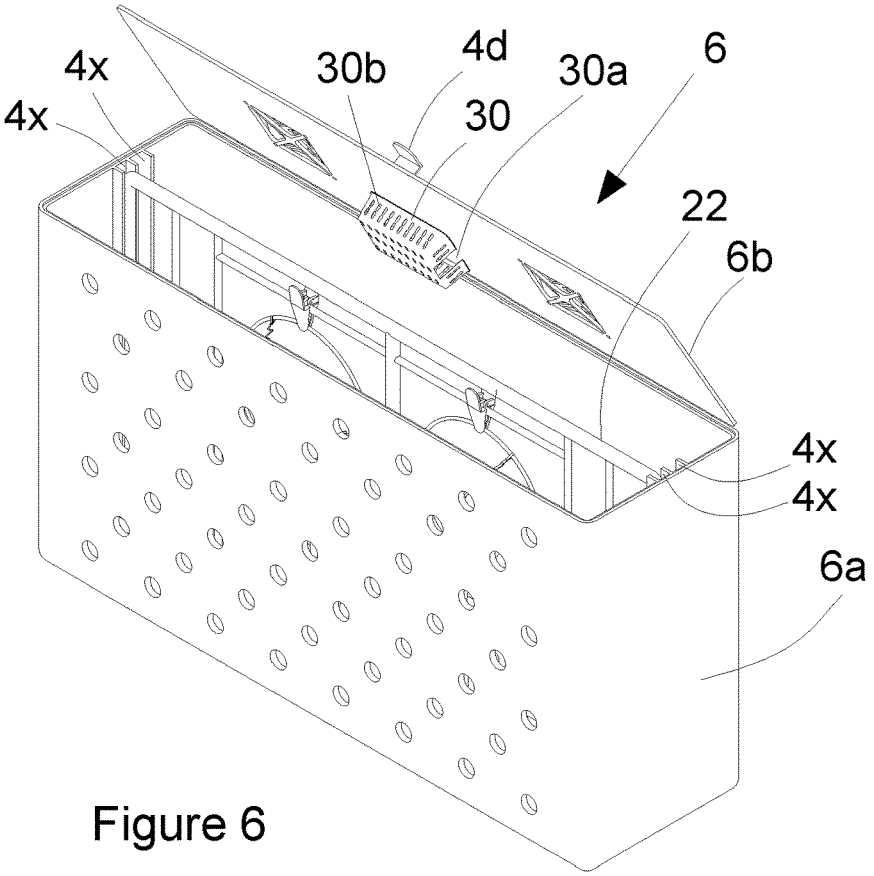
FIG. 6 shows an isometric view solely of the dryer unit shown opened.

FIG. 6 shows the placement of the support grille 22 inside the container 6*a* of the dryer compartment 6. A basket 30 affixed to the door 6*b* suspends from underneath the door 6*b* of the container 6*a*. The basket 30 has side openings 30*a* large enough to allow the insertion of a fabric softener sheet to make lingerie scented and smell fresh after air-drying. The basket 30 is riddled with vents holes 30*b* to allow air to circulate inside the basket 30 and carry the scent from the fabric softener sheet. The basket 30 can be used to hold permeable bags filled with special salts coated with scented oils to make the lingerie smell fresh.

It is envisioned that the washer and dryer unit 2 can be implemented with the option of having a comfortable detergent dispenser allowing detergent to dissolve and be distributed evenly over the garment. It is further envisioned that the container 6*a* of the dryer compartment is to have a drain outlet connected with a joint coupler with the outlet port 4*r* so that it drains through the same conduit. It is further envisioned that the container 4*a*, 6*a* be designed so that a bottom surface tapers towards the drain outlet. The pompoms 22 can all be made from any sized diameter string or combined with different sized diameters. It should be noted that reference to gears 4*k* have been shown and described, but it is envisioned that sprockets can be used instead of gears and so the term gears encompasses also sprockets by our definition. The arrays of gears can be covered with a panel to protect against human hands or anything that can be wedged in the gears. It is envisioned that more than one support grille 22 can be provided with the unit so that one is holding a garment for drying while the other is holding a garment for washing. It is further envisioned that the unit 12 can be implemented with a retractable handle to ease moving the unit around. It is envisioned that the compartments can be made from stainless steel or a combination of stainless steel and plastic, or all made from plastic material.

The invention claimed is:

1. A washer and dryer unit comprising a washer compartment, a dryer compartment, a base, a servomotor, and a control panel;

wherein both the washer compartment and the dryer compartment sit on the base;

wherein the washer compartment comprises a container and a slidable cover having an internal seal to engage the container;

wherein the container includes at least one pompom facing at least one pompom of the cover;

wherein the washer compartment further comprises a gear rotatably fixed to the container and a gear rotatably fixed to the cover; and, wherein the pompom of the container is connected to an axial shaft projecting from the gear of the container;

wherein the pompom of the cover is connected to an axial shaft projecting from the gear of the cover; and, wherein the pompoms able to reciprocate back and forth using the servomotor.

2. The washer and dryer unit of claim 1, wherein each pompom is made from bundled strings made of polyether-polyurea copolymer.

3. The washer and dryer unit of claim 2, wherein a shaft support extends from the container and a shaft support extends from the cover;

wherein the shaft of one gear intersects a shaft seal and the shaft support of the container;

wherein the shaft of the other gear intersects a shaft seal and the shaft support of the cover;

wherein the shaft seal comprising a pair of elastic discs made from a polyurethane material coated with adhesive on one side, a flexible bridge tube between the discs, and grease filling the bridge tube; and, wherein one of the discs abuts the shaft support.

4. The washer and dryer unit of claim 3, wherein each shaft seal further include a cover tube expanding over the two discs.

5. The washer and dryer unit of claim 3, wherein the shaft support comprises a disc and a boss projecting from either side of the disc; and, wherein one of the bosses extends through an opening in the container, the cover, or both.

6. The washer and dryer unit of claim 1, wherein the container includes a propeller and an electric motor attached to the propeller.

7. The washer and dryer unit of claim 1, wherein the container includes a hinged door, a set of parallel U-shaped channels extending vertical to the container, and another set of parallel U-shaped channels extending horizontal to the container.

8. The washer and dryer unit of claim 2, wherein the dryer compartment comprises a container, a hinged cover, and at least one fan;

wherein the container of the washer compartment includes a hinged door, a set of parallel U-shaped channels extending vertical to the container, and another set of parallel U-shaped channels extending horizontal to the container; and, wherein the container of the dryer compartment includes a hinged door, a set of parallel U-shaped channels extending vertical to the container of the dryer compartment.

9. The washing and dryer unit of claim 1, wherein a bridge gear is rotatably attached to the container;

wherein another bridge gear is rotatably attached to the cover of the washer compartment;

wherein a drive gear is rotatably attached to the container to be rotated by the servomotor;

wherein the drive gear engages the bridge gear that is attached to the container; and, wherein the bridge gear that is attached to the cover being engageable with the drive gear when the cover is sealed with the container, or disengaged from the drive gear when the cover is opened.

10. The washing and dryer unit of claim 1, wherein the container incudes an inlet port and a drain port; and, wherein a closed pipe connects to the inlet port and extends across the container, and the closed pipe includes an array of drain ports.

11. The washing and dryer unit of claim 8, wherein the dryer compartment further includes a basket suspended from the door of the dryer compartment; and, wherein the basket includes at least one side opening.

12. The washing and dryer unit of claim 7, wherein container further includes a hook.

13. A washer and dryer unit comprising a washer compartment, a dryer compartment, a base, a servomotor, a control panel, and a support grille;

wherein both the washer compartment and the dryer compartment sit on the base;

wherein the washer compartment comprises a container; wherein the dryer compartment comprises a container;

wherein the container of the washer compartment and the container of the dryer compartment each comprises a set of parallel U-shaped channels extending vertical to the container; and, wherein the support grille being slidable in any of the U-shaped channels.

14. The washer and dryer unit of claim 13, wherein the support grille comprises a main bar, a bisecting pole extending from the main bar, and at least two clips;

wherein two bridge bars extend from the bisecting pole in opposite directions;

wherein two crossbars extend from the bisecting pole in opposite direction;

wherein the crossbars and the bridge bars are parallel to each other; and, wherein the clips are fixed to either the bridge bars or the crossbars.

15. The washer and dryer unit of claim 14, wherein each clip supports a cup support that is collapsible; and, wherein each clip being slidable along the bridge bars or the crossbars.

16. The washer and dryer unit of claim 15, wherein each cup support comprises three sized rings and at least two flexible connectors connecting the three sized rings.

17. The washer and dryer unit of claim 14, wherein mid bars extend from the main bar and being parallel to the bisecting pole.

18. The washer and dryer unit of claim 14, wherein short legs extends from the crossbars; and, wherein hooks extends from the short legs.

19. The washer and dryer unit of claim 13, wherein the support grille comprises a main bar, a bisecting pole extending from the main bar, and four clips;

wherein two bridge bars extend from the bisecting pole in opposite directions;

wherein two crossbars extend from the bisecting pole in opposite directions;

wherein the crossbars and the bridge bars are parallel to each other; and, wherein a pair of the clips is fixed to the bridge bars, and another pair of the clips is fixed the crossbars.

20. The washer and dryer unit of claim 13, wherein the washer compartment further comprises a slidable cover having an internal seal to engage the container of the washer.

* * * * *